US007801458B2

(12) United States Patent
Kim

(10) Patent No.: US 7,801,458 B2
(45) Date of Patent: Sep. 21, 2010

(54) IMAGE FORMING APPARATUS TO CONTROL PRINT CONCENTRATION AND METHOD OF CONTROLLING THE SAME

(75) Inventor: Hyou Jin Kim, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 253 days.

(21) Appl. No.: 12/025,309

(22) Filed: Feb. 4, 2008

(65) Prior Publication Data

US 2008/0193149 A1 Aug. 14, 2008

(30) Foreign Application Priority Data

Feb. 8, 2007 (KR) ..... 10-2007-13353
Jan. 23, 2008 (KR) ..... 10-2008-06911

(51) Int. Cl.
*G03G 15/00* (2006.01)

(52) U.S. Cl. ..... 399/72; 399/15

(58) Field of Classification Search ..... 399/15, 399/72, 82, 85
See application file for complete search history.

(56) References Cited

U.S. PATENT DOCUMENTS 5,602,637 A * 2/1997 Hara et al. ..... 399/72 X
6,973,273 B2 * 12/2005 Kuboki ..... 399/15
7,424,238 B2 * 9/2008 Yamauchi et al. ..... 399/82
7,616,906 B2 * 11/2009 Yamamoto ..... 399/15

FOREIGN PATENT DOCUMENTS

JP 2006-343679 12/2006
KR 2005-46042 5/2005

OTHER PUBLICATIONS

Chinese Office Action dated Dec. 4, 2009 issued in CN Application No. 2008100884969.

* cited by examiner

*Primary Examiner*—Sandra L Brase
(74) *Attorney, Agent, or Firm*—Stanzione & Kim, LLP

(57) ABSTRACT

An image forming apparatus to print at least one of a plurality of test images and texts at various print concentration levels such that confusion of a user due to a change of a print concentration level is prevented, and a method of controlling the same. The method of controlling an image forming apparatus includes receiving confirmation of a print concentration level to print an image and printing at least one of test images and texts having predetermined print concentrations according to a normal print mode and a toner conservation mode, according to the received confirmation of the print concentration level.

14 Claims, 5 Drawing Sheets

IMAGE FORMING APPARATUS TO CONTROL PRINT CONCENTRATION AND METHOD OF CONTROLLING THE SAME

CROSS-REFERENCE TO RELATED APPLICATIONS

This application claims the benefit of Korean Patent Application No. 2007-13353, filed on Feb. 8, 2007, in the Korean Intellectual Property Office, and No. 2008-06911, filed on Jan. 23, 2008, in the Korean Intellectual Property Office, the disclosures of which are incorporated herein by reference in their entirety.

BACKGROUND OF THE INVENTION

1. Field of the Invention

The present general inventive concept relates to an image forming apparatus and a method of controlling the same, and more particularly, to an image forming apparatus to print at least one of a plurality of test images and texts at a plurality of print concentrations, and a method of controlling the same.

2. Description of the Related Art

Generally, an image forming apparatus includes a toner conservation mode for reducing the amount of a toner or ink used for developing an image. The toner conservation mode may be implemented by various methods according to the type of the image forming apparatus.

For example, if the image forming apparatus is a laser printer, a control unit of the laser printer supplies a voltage lower than a normal voltage supplied to a development roller in the toner conservation mode. Then, the amount of a toner supplied from the development roller to a photosensitive drum is reduced such that an image is printed on a sheet of paper at a print concentration lower than a normal print concentration.

The image forming apparatus having the toner conservation mode can allow a user to select whether or not the toner conservation mode is executed. If the toner conservation mode is selected, the toner conservation mode is applied to all output material, and thus the toner can be conserved.

However, when the conventional image forming apparatus having the toner conservation mode performs a printing operation at the print concentration lower than the normal print concentration, the user may come to an incorrect conclusion that the apparatus is operating abnormally.

SUMMARY OF THE INVENTION

The present general inventive concept provides an image forming apparatus to print at least one of a plurality of test images and texts at a plurality of print concentrations, and a method of controlling the same.

Additional aspects and/or utilities of the general inventive concept will be set forth in part in the description which follows and, in part, will be obvious from the description, or may be learned by practice of the general inventive concept.

The foregoing and/or other aspects and utilities of the present general inventive concept are achieved by providing a method of controlling an image forming apparatus, the method including: receiving confirmation of a print concentration level to print an image; and printing at least one of test images and texts having predetermined print concentrations according to a normal print mode and a toner conservation mode, according to the received confirmation of the print concentration level.

The printing may include printing at least one of the test images and texts having the predetermined print concentrations according to the normal print mode and the toner conservation mode on a sheet of paper.

The printing may include dividing and printing at least one of the test images and texts according to colors if at least one of the test images and texts includes a plurality of colors.

The printing may include controlling the print position of at least one of the test images and texts using print position information of at least one of the test images and texts and printing at least one of test images and texts. The print position information may be time information.

The method may further include receiving a change command and change position information of the print position of at least one of the test images and texts. The printing may include changing the print position of at least one of the test images and texts using the change position information and printing at least one of test images and texts.

The method may further include displaying the print concentrations according to the normal print mode and the toner conservation mode.

The foregoing and/or other aspects and utilities of the present general inventive concept may also be achieved by providing an image forming apparatus including: an input unit to receive confirmation of print concentrations levels to print an image; and a control unit to control at least one of test images and texts having predetermined print concentrations according to a normal print mode and a toner conservation mode to be printed, according to the received confirmation of the print concentration level.

The input unit may further receive a change command and change position information of the print position of at least one of the test images and texts.

The control unit may control the print position of at least one of the text images and texts to be changed using the change position information.

The control unit may control at least one of the test images and texts to be divided and printed according to colors if at least one of the test images and texts includes a plurality of colors.

The image forming apparatus may further include a memory unit to store at least one of the test images and texts and print position information.

The image forming apparatus may further include a display unit to display the print concentrations according to the normal print mode and the toner conservation mode.

BRIEF DESCRIPTION OF THE DRAWINGS

These and/or other aspects and utilities of the general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
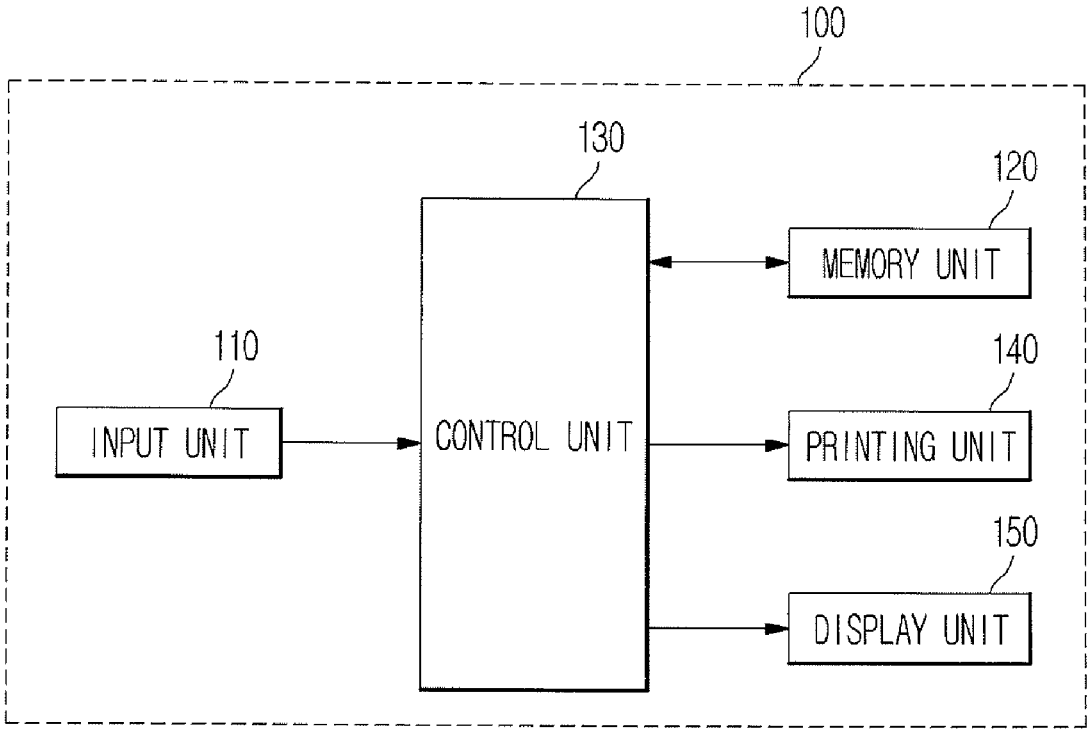
FIG. 1 is a block diagram illustrating an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram illustrating an image forming apparatus according to an embodiment of the present general inventive concept. As illustrated in FIG. 1, the image forming apparatus 100 includes an input unit 110, a memory unit 120, a control unit 130, a printing unit 140, and a display unit 150.

The input unit 110 receives a control command such as a print mode (a normal print mode or a toner conservation mode), a menu, a scan function, and an ejection/selection function. The input unit 110 also receives a confirmation command of print concentration levels to confirm a print concentration state. Here, the confirmation command of the print concentration is a command to print at least one of a plurality of test images and texts at various print concentrations and to provide a user with the print concentration state.

The confirmation command of the print concentration levels may be received through a screen display unit such as a liquid crystal display (LCD) and a plurality of buttons. Alternatively, the confirmation command of the print concentration levels may be manually or automatically received through a printer driver of a terminal device connected to the image forming apparatus 100.

The input unit 110 can further receive a change command to change the print position of at least one of the test images and texts and change position information corresponding to the change command. That is, if the print position of a test image or text to be printed on a sheet of paper is desired to be changed, the input unit 110 receives the change command to request the change of the print position and the change position information indicating the position to be changed.

The test images and texts will be described in detail together with the memory unit 120, and the change of the print position will be described in detail together with the control unit 130.

The memory unit 120 stores the plurality of test images and texts, information on the capacities, colors and concentrations of the test images and texts, print position information of the test images and texts according to the type of image recording medium, and the print concentration levels of the test images and texts. Here, the test images and texts indicate images and texts which are printed in order to check a current print concentration state. The text images include figures, symbols, dots and lines and the test texts include characters and letters. At this time, the test images and texts are arranged in a sheet traveling direction.

Figure 2:
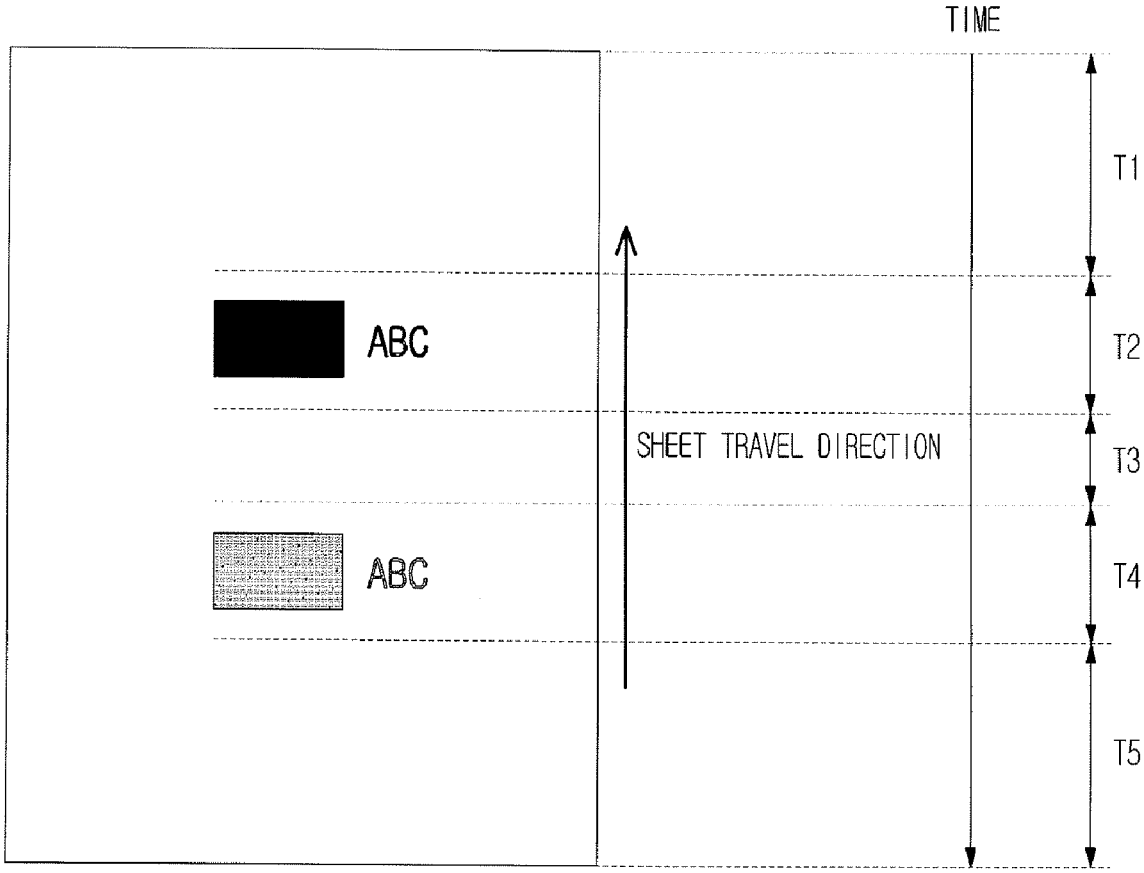
FIG. 2 is a view illustrating test images and texts printed on a sheet of paper at print concentrations according to a normal print mode and a toner conservation mode in accordance with an embodiment of the present general inventive concept.

The memory unit 120 stores the print position information of at least one of the test images and texts, which varies according to the type of the sheet (that is, the size of the sheet). Referring to FIG. 2, for example, if the type of the sheet or other recording medium is A4, the memory unit 120 stores first print position information of T1:0.7 sec, T2:0.3 sec, T3:0.7 sec, T4:0.3 sec, and T5:0.7 sec in correspondence with a first test image. In contrast, if the type of the sheet is B5, the memory unit 120 stores second print position information of T1:0.4 sec, T2:0.3 sec, T3:0.4 sec, T4:0.3 sec, and T5:0.4 sec in correspondence with a first test image.

The memory unit 120 stores the print concentration level corresponding to at least one of the test images and texts. For example, if the normal print concentration is 100%, the memory unit 120 can store a print concentration of 70% (print concentration of the toner conservation mode) as a first reference image and a print concentration of 120% as a second reference image.

The control unit 130 determines whether the confirmation of the print concentration is received (that is, determines whether the confirmation command of the print concentration is received through the input unit 110) and prints at least one of the plurality of test images and texts having different print concentration levels if the confirmation of the print concentration is received.

In more detail, the control unit 130 prints at least one of the test images and texts having predetermined print concentration levels according to the normal print mode and the toner conservation mode. Here, the print concentration level according to the normal print mode is a normal print concentration level and the print concentration level according to the toner conservation mode is a print concentration level that is lower than the print concentration level according to the normal print mode. At this time, if the image forming apparatus 100 is a laser printer, the amount of a toner is adjusted and then an image is formed. Accordingly, in this case, the control unit 130 changes the power level or the size of a laser scanning unit (LSU) or a high voltage condition so as to change the print concentration level and also performs the printing operation. If the image forming apparatus 100 is an inkjet printer, the control unit 130 adjusts the amount of ink to be ejected so as to change the print concentration level and also performs the printing operation.

The control unit 130 controls the print position of at least one of the test images and texts to be printed on a sheet of paper using the print position information of at least one of the test images and texts according to the type of the sheet. That is, the control unit 130 receives the type of the sheet, determines whether the print position information of at least one of the test images and texts corresponding to the type of the sheet exists, and controls the print position of at least one of the test images and texts using the print position information if the print position information of at least one of the test images and texts corresponds to the type of the sheet.

Alternatively, the control unit 130 may directly obtain the print position information of the test images or texts using the information on the capacities, colors and concentrations of the test images or texts.

FIG. 2 is a view illustrating test images and texts printed on the sheet at print concentrations according to the normal print mode and the toner conservation mode in the present invention. As illustrated in FIG. 2, the control unit 130 controls the test images and texts to be printed on the sheet at print concentration levels according to the normal print mode and the toner conservation mode such that the user can easily confirm the print concentration levels.

At this time, the print position information includes a time period T1 (a time period from the start of the printing operation to before the test images and texts are printed), a time period T2 (a time period while the test images and texts are printed at the print concentration level of the normal print mode), a time period T3 (a time period to before the test images and texts are printed at the print concentration level of the toner conservation mode), a time period T4 (a time period while the test images and texts are printed at the print concentration level of the toner conservation mode), and a time period T5 (a time period from after the test images and texts are printed at the print concentration level of the toner conservation mode to the end of the printing operation) and includes time information about each of the time periods T1-T5.

The control unit 130 determines whether the print position of at least one of the test images and texts is required to be changed (that is, determines the change command is received through the input unit 110) and controls the print position of at least one of the test images and texts, which will be printed on the sheet, to be changed using the change position information. That is, if the user wants to change the print position of at least one of the test images and texts, the control unit 130 receives the change command and the change position information from the input unit 110 and changes the print position of at least one of the test images and texts using the change position information.

If the printing unit 140 to print at least one of the test images and texts on the sheet is controlled by a high voltage, the control unit 130 controls the print position so as to ensure a time for stably changing the high voltage between the test images and texts.

Meanwhile, if at least one of the test images and texts includes a plurality of colors, the control unit 130 controls at least one of the test images and texts to be divided and printed according to the colors. That is, if at least one of the test images and texts include all colors of cyan (C), magenta (M) and yellow (Y), the control unit 130 controls at least one of the test images and texts of cyan (C), at least one of the test images and texts of magenta (M) and at least one of the test images and texts of yellow (Y) to be divided and printed.

Figure 3A:
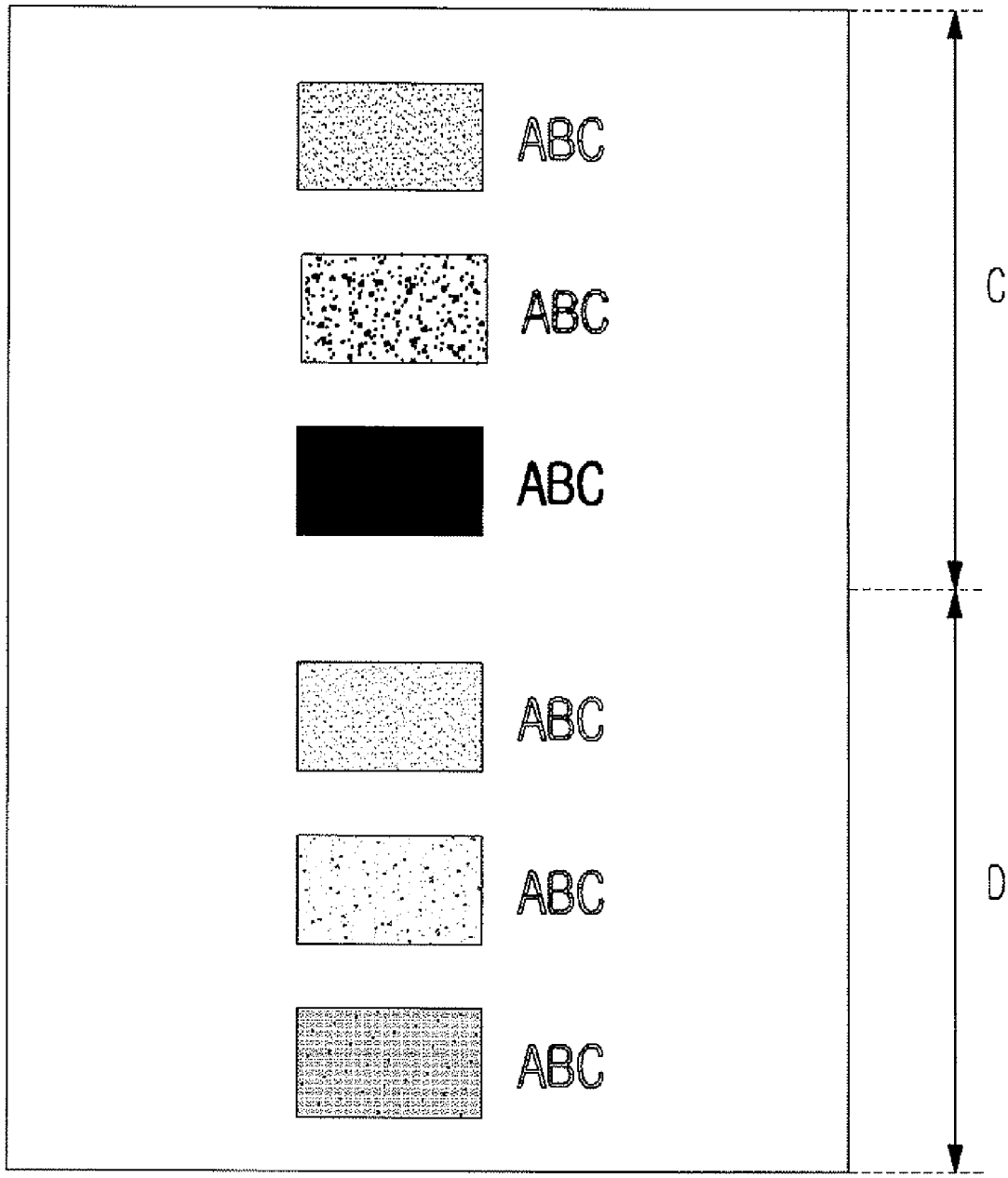
FIGS. 3A and 3B are views illustrating a state in which the test images and texts shown in FIG. 2 are divided and printed according to colors.
Figure 3B:
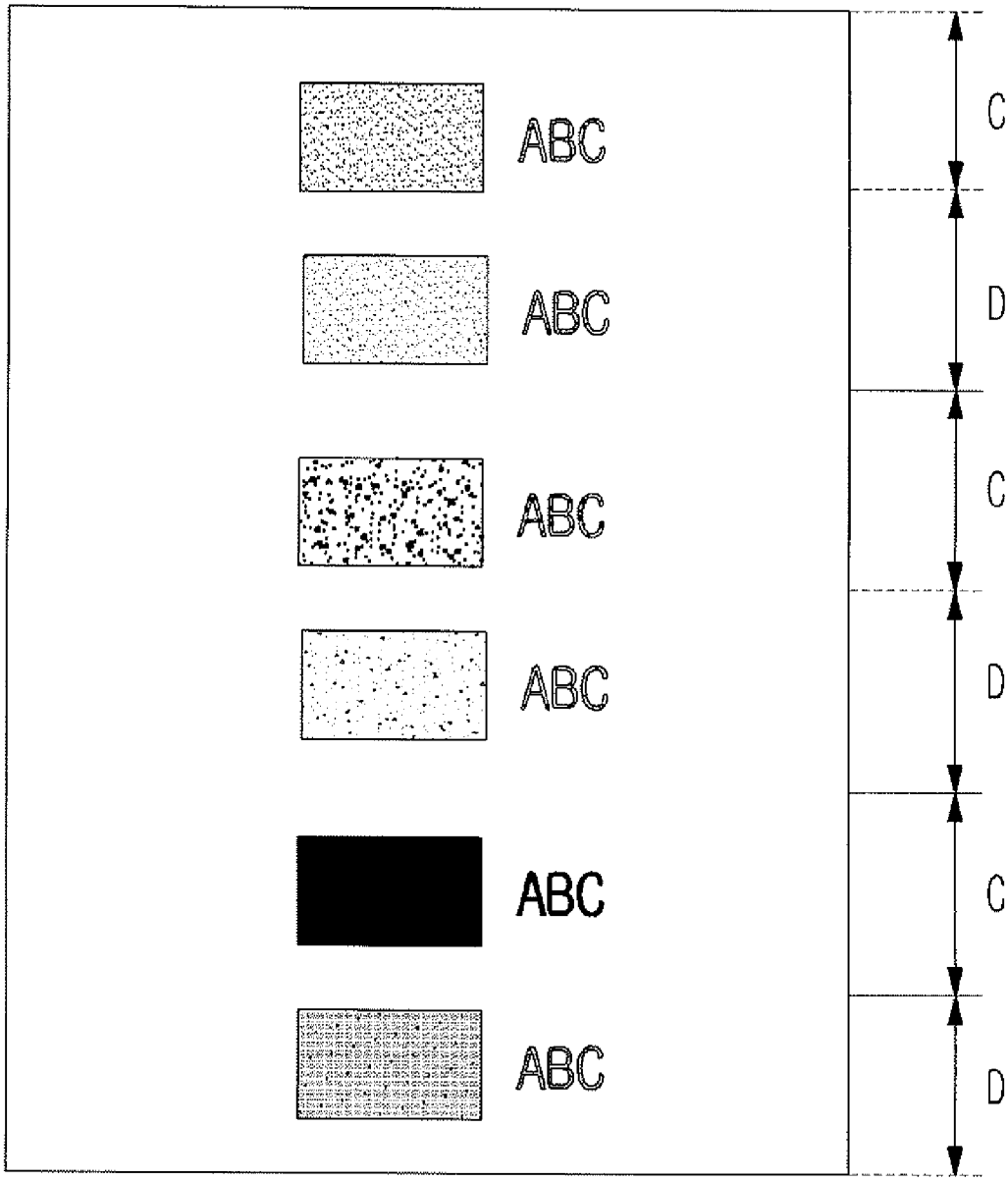

FIGS. 3A and 3B are views illustrating a state in which the test images and texts illustrated in FIG. 2 are divided and printed according to the colors. As illustrated in FIG. 3A, the test images and texts of an area C having the print concentration level of the normal print mode are divided and printed by the control unit 130 according to the colors, and the test images and texts of an area D having the print concentration level of the toner conservation mode are divided and printed by the control unit 130 according to the colors, similar to the test images and texts of the area C.

Referring to FIG. 3B, similar to FIG. 3A, the test images and texts of the area C are printed at the print concentration level of the normal print mode and the test images and texts of the area D are printed at the print concentration level of the toner conservation mode. Here, however, in FIG. 3B, the test images and texts are grouped together in colors, such that a color in the normal print mode and the conservation print mode are grouped next to each other.

Meanwhile, if the toner conservation mode is previously set in the image forming apparatus 100, the control unit 130 gives pause to the toner conservation mode when the confirmation of the print concentration level is received and resumes the toner conservation mode after the confirmation of the print concentration level is completed.

The printing unit 140 prints the test images or texts. That is, the printing unit 140 indicates a mechanical unit to print the test images or texts on the sheet. For example, in the laser printer, a photosensitive drum, a charging unit, the LSU, a transferring unit, a development unit, a feeding unit and an ejection unit are included in the printing unit 140.

The display unit 150 displays the print concentrations according to the normal print mode and the toner conservation mode and includes an LCD, a PDP, a TFT, an organic EL display, and a CRT. The display unit 150 may be included in the image forming apparatus 100 or may be included in another device connected to the image forming apparatus 100.

Figure 4:
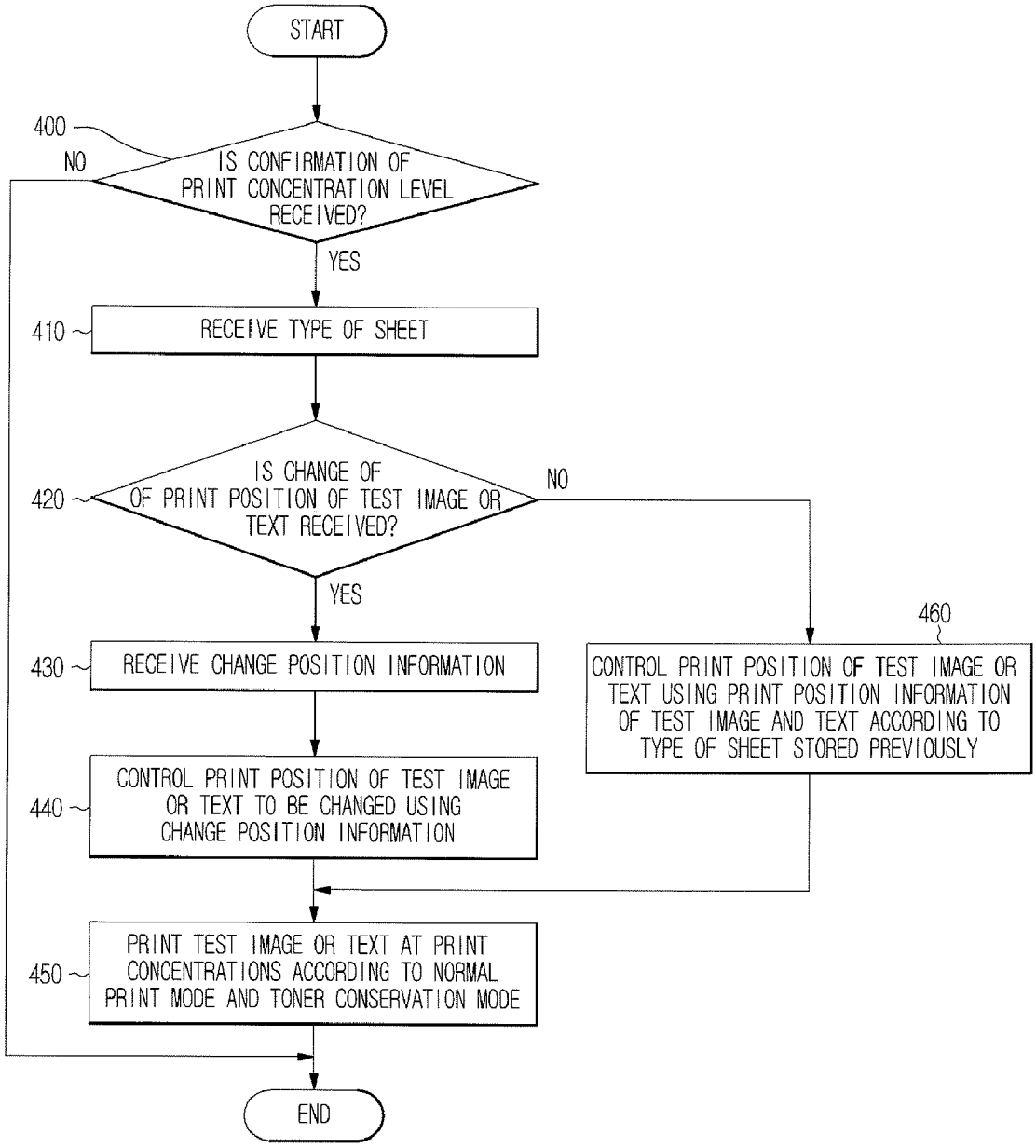
FIG. 4 is a flowchart illustrating a method of controlling an image forming apparatus according to an embodiment of the present general inventive concept.

FIG. 4 is a flowchart illustrating a method of controlling an image forming apparatus according to an embodiment of the present general inventive concept. As illustrated in FIG. 4, the control unit 130 determines whether the confirmation of the print concentration level is received through the input unit 110 (operation S400).

In Operation 400, if the confirmation of the print concentration level is received, then the control unit 130 receives the type of the sheet (operation S410). At this time, the control unit 130 may manually receive the type of the sheet or may automatically receive the type of the sheet which is previously set in the image forming apparatus 100.

Next, the control unit 130 determines whether the change of the print position of at least one of the test images and texts is received (operation S420). That is, if the user wants to change the print position of at least one of the test images and texts, the control unit 130 determines whether the change of the print position of at least one of the test images and texts is received through the input unit 110.

If the change of the print position of at least one of the test images and texts is received in Operation 420, then the input unit 110 further receives the change position information at Operation 430 according to the received change of the print position.

The print position of at least one of the test images and texts is controlled to be changed using the received change position information (operation S440).

At least one of the test images and texts are printed at the print concentrations according to the normal print mode and the toner conservation mode (operation S450).

If the change of the print position of at least one of the test images and texts is not received in Operation 420, then the print position of at least one of the test images and texts is controlled using the print position information of at least one of the test images and texts according to the type of the sheet which is previously stored in the memory unit 120 (operation S460).

After the print position of at least one of the test images and texts is controlled, at least one of the test images and texts is printed at the print concentrations according to the normal print mode and the toner conservation mode (operation S450).

As described above, in an image forming apparatus and a method of controlling the same according to the embodiments of the present general inventive concept, at least one of a plurality of test images and texts is printed at various print concentrations. Accordingly, it is possible to prevent confusion of a user due to the change of a print concentration.

Although a few embodiments of the present general inventive concept have been shown and described, it would be appreciated by those skilled in the art that changes may be made in these embodiments without departing from the principles and spirit of the general inventive concept, the scope of which is defined in the appended claims and their equivalents.

What is claimed is:

1. A method of controlling an image forming apparatus, the method comprising:

receiving confirmation of a print concentration level to print an image; and printing at least one of test images and texts having predetermined print concentrations according to a normal print mode and a toner conservation mode, according to the received confirmation of the print concentration level.

2. The method according to claim 1, wherein the printing comprises printing at least one of the test images and texts having the predetermined print concentrations according to the normal print mode and the toner conservation mode on a sheet of paper.

3. The method according to claim 1, wherein the printing comprises dividing and printing at least one of the test images and texts according to colors if at least one of the test images and texts includes a plurality of colors.

4. The method according to claim 1, wherein the printing comprises controlling the print position of at least one of the test images and texts using print position information of at least one of the test images and texts and printing at least one of the test images and texts.

5. The method according to claim 4, wherein the print position information is time information.

6. The method according to claim 1, further comprising:

receiving a change command and change position information of the print position of at least one of the test images and texts.

7. The method according to claim 6, wherein the printing comprises changing the print position of at least one of the test images and texts using the change position information and printing at least one of test images and texts.

8. The method according to claim 1, further comprising:

displaying the print concentration level according to the normal print mode and the toner conservation mode.

9. An image forming apparatus comprising:

an input unit to receive confirmation of a print concentration level to print an image; and a control unit to control at least one of test images and texts having predetermined print concentrations according to a normal print mode and a toner conservation mode to be printed, according to the received confirmation of the print concentration level.

10. The image forming apparatus according to claim 9, wherein the input unit further receives a change command and change position information of the print position of at least one of the test images and texts.

11. The image forming apparatus according to claim 10, wherein the control unit controls the print position of at least one of the text images and texts to be changed using the change position information.

12. The image forming apparatus according to claim 9, wherein the control unit controls at least one of the test images and texts to be divided and printed according to colors if at least one of the test images and texts includes a plurality of colors.

13. The image forming apparatus according to claim 9, further comprising:

a memory unit to store at least one of the test images and texts and print position information.

14. The image forming apparatus according to claim 9, further comprising:

a display unit to display the print concentration level to print an image according to the normal print mode and the toner conservation mode.

* * * * *